US012782095B2

(12) United States Patent
Smith et al.

(10) Patent No.: US 12,782,095 B2
(45) Date of Patent: Nov. 3, 2026

(54) FIN STABILIZED PROJECTILE

(71) Applicant: Crossbullet, LLC, Nunnelly, TN (US)

(72) Inventors: Nathan E. Smith, Hamlin, NY (US); Robert Tuchrelo, Williamson, NY (US); Paul K. Maurer, Nunnelly, TN (US); Richard T. Aab, Fairport, NY (US)

(73) Assignee: Crossbullet, LLC, Nunnelly, TN (US)

( * ) Notice: Subject to any disclaimer, the term of this patent is extended or adjusted under 35 U.S.C. 154(b) by 0 days.

(21) Appl. No.: 19/067,048

(22) Filed: Feb. 28, 2025

(65) Prior Publication Data

US 2025/0271245 A1 Aug. 28, 2025

Related U.S. Application Data

(60) Provisional application No. 63/558,909, filed on Feb. 28, 2024.

(51) Int. Cl.
*F42B 10/06* (2006.01)

(52) U.S. Cl.
CPC ..... *F42B 10/06* (2013.01)

(58) Field of Classification Search
CPC ..... F42B 10/06
See application file for complete search history.

(56) References Cited

U.S. PATENT DOCUMENTS

| | | | | |
|---|---|---|---|---|
| 1,293,869 | A | 2/1919 | Murray et al. | |
| 1,879,840 | A | 9/1932 | William | |
| 2,045,833 | A | 6/1936 | Childs | |
| 2,573,362 | A | 10/1951 | Rouse | |
| 3,151,412 | A | 10/1964 | Swindle | |
| 3,292,879 | A | 12/1966 | Saxton | |
| 3,566,528 | A | 3/1971 | Musser | |
| 3,620,167 | A | 11/1971 | Romer et al. | |
| 3,745,926 | A | 7/1973 | Mertz et al. | |
| 3,759,184 | A | 9/1973 | Blajda et al. | |
| 4,209,146 | A * | 6/1980 | Mattson | F42B 10/14 244/3.27 |
| 4,524,695 | A | 6/1985 | Bisping et al. | |
| 4,643,071 | A | 2/1987 | Baechler et al. | |
| 4,829,904 | A | 5/1989 | Sullivan et al. | |
| 4,907,646 | A | 3/1990 | Ayagi et al. | |
| 5,092,246 | A | 3/1992 | Huerta et al. | |
| 5,476,045 | A | 12/1995 | Chung et al. | |
| 5,657,947 | A * | 8/1997 | Mayersak | F42C 19/00 89/1.56 |

(Continued)

*Primary Examiner* — Justin M Benedik
(74) *Attorney, Agent, or Firm* — Douglas R. Smith; Harter Secrest & Emery, LLP

(57) ABSTRACT

The present disclosure provides a fin stabilized projectile which can accommodate subsonic and supersonic flight velocities, wherein flight performance characteristics of the projectile are stabilized. The projectile is configured to be incorporated into a sabot free cartridge, wherein the projectile can be launched from a smooth bore barrel. The projectile includes an elongate body having a diverging ogival nose section extending rearward from a leading end, a converging ogival back section terminating at a trailing end; and a tail segment having a tail fin projecting radially from the back section and extending longitudinally forward of the trailing end of the elongate body and extending longitudinally rearward of the trailing end of the elongate body.

36 Claims, 7 Drawing Sheets

(56) References Cited

U.S. PATENT DOCUMENTS

| | | | | |
|---|---|---|---|---|
| 6,314,886 | B1 * | 11/2001 | Kuhnle | F42B 10/14 244/3.28 |
| 6,655,293 | B1 | 12/2003 | Henry et al. | |
| 6,699,091 | B1 * | 3/2004 | Warner | A63H 23/00 446/163 |
| 7,781,709 | B1 * | 8/2010 | Jones | F42B 10/60 102/382 |
| 8,291,828 | B2 | 10/2012 | Glasser | |
| 8,735,789 | B1 | 5/2014 | Malejko | |
| 9,360,286 | B2 * | 6/2016 | Pettersson | F42B 10/14 |
| 9,581,402 | B2 | 2/2017 | Minnicino | |
| 9,644,929 | B1 | 5/2017 | Bradbury et al. | |
| 10,352,669 | B2 | 7/2019 | Fournier et al. | |
| 10,520,291 | B1 | 12/2019 | Vasudevan et al. | |
| 11,181,351 | B2 | 11/2021 | Mahnke | |
| 11,519,704 | B1 | 12/2022 | Dille | |
| 2008/0127850 | A1 | 6/2008 | Radchenko | |
| 2017/0003107 | A1 | 1/2017 | McWilliam, Sr. et al. | |
| 2017/0131071 | A1 | 5/2017 | Burkart et al. | |
| 2019/0212114 | A1 | 7/2019 | Kunz et al. | |
| 2020/0217632 | A1 | 7/2020 | Mahnke | |
| 2020/0309491 | A1 | 10/2020 | Berger | |
| 2022/0065578 | A1 | 3/2022 | Conle | |
| 2022/0357135 | A1 | 11/2022 | Stutz | |
| 2022/0373308 | A1 * | 11/2022 | Maurer | F42B 10/08 |
| 2023/0044162 | A1 * | 2/2023 | Maurer | F42B 5/025 |

* cited by examiner

FIN STABILIZED PROJECTILE

CROSS-REFERENCE TO RELATED APPLICATIONS

This application claims the benefit of U.S. Provisional Application No. 63/558,909, filed Feb. 28, 2024, and entitled FIN STABILIZED PROJECTILE, the entirety of which is hereby incorporated by reference.

BACKGROUND OF THE INVENTION

Field of the Invention

The present disclosure is related to a projectile configured for fin stabilized flight, without requiring spin stabilization. In one configuration, the projectile includes an elongate body extending along a longitudinal axis from a body leading end to a body trailing (converging) end, the elongate body having a diverging ogival nose segment extending rearward from the body leading end and a converging ogival back segment terminating at the body trailing (converging) end, and a tail segment having at least one tail fin.

Description of Related Art

Historically, spin stabilization has been used for firearm projectiles. The spin stabilization is typically imparted by a rifled barrel. That is, the bore of the barrel of the firearm has longitudinally extending helical grooves (known as rifling) cut into the surface bore. The rifling includes lands (raised areas) and grooves (lower areas), extending longitudinally along the bore, which engage with the projectile, imparting the spin. The specific design of lands and grooves can vary, impacting the performance of the firearm, both as by design as well as a result of wear.

The spin imparted to the projectile by traditional rifling provides gyroscopic stability, often referred to spin stabilization, to the projectile during flight. Spin stabilization helps maintain the orientation of the projectile in flight, resulting in improved accuracy and a longer effective range. Rifling has been used for centuries, and thus the technology has been refined over an extended time. The design and manufacturing processes for rifled barrels and spin stabilized projectiles are well established and widely adopted. Further, rifled barrels can accommodate a wide range of projectile shapes and sizes for a given caliber. This versatility is crucial for firearms, as a given barrel may need to fire various types of ammunition, including hollow points, armor-piercing rounds, and other specialized projectiles. In addition, relatively fast rates of fire can be achieved with rifled barrels. Most firearms are designed for short to medium range engagements, wherein the benefits of spin stabilization in terms of accuracy and stability are well balanced for these distances.

BRIEF SUMMARY OF THE INVENTION

However, there are disadvantages to spin (or gyroscopically) stabilized projectiles. For example, the spin stabilization represents an amount of energy that cannot be otherwise employed in the velocity of the projectile. That is, the energy used to induce spin could have been used to impart translational velocity to the projectile. In addition, the deformation of the projectile by the rifling when imparting the spin further reduces the available energy for the velocity of the projectile. Barrel wear is also a result of imparting spin stabilization. As the barrel wears, the accuracy of the barrel decreases, resulting in a need to replace the barrel.

An alternative to spin stabilization is fin stabilization. Fin stabilized projectiles include at least one fin configured to stabilize the projectile during external ballistics. Fin stabilized projectiles do not engage with the barrel to impart spin, thus more energy is available for projectile velocity. Therefore, the fin stabilized projectile will have a greater muzzle velocity than a comparable spin stabilized projectile. In addition, fin stabilized projectiles can be designed to optimize stability and minimize drag, resulting in improved overall external ballistic performance. Further, in contrast to gyroscopic spin stabilization through engagement of the projectile with the rifled barrel to shape the projectile and impart the spin, the barrel for the fin projectile does not impart spin and thus there is de minimis forming or shaping contact between the projectile and the barrel. This lack of, or reduced, shaping contact reduces wear of the barrel. The reduced wear improves accuracy, including long term accuracy, as the wear of the barrel can change the resulting flight characteristics of the projectile thereby adding variability to flight characteristics and thus reduced accuracy. Concomitantly, the non-rifled (smooth) bore exhibits less wear for a given number of firings than the rifled bore, thereby reducing replacement costs. Also, it is believed that fin stabilized projectiles can maintain stability even when fired from relatively short-barreled weapons.

With reference to FIG. 1A, for any object there must be a center of mass (COM), and if the object is moving through the air, there will be a center of pressure (CoP) which is the location at which the aerodynamic forces act upon the object. If the CoP is behind the COM relative to the flow of air, the aerodynamic forces will cause correcting moments about the center of mass. As a result, the object will self-straighten as/if the angle of attack (AoA) varies from 0°. Thus, for a projectile 50, one or more fins 52 are typically used to move the CoP rearward while a multi-piece and/or multi-material projectile body 54 allows for forward biasing of the CoM. It is further believed that the energy otherwise used in imparting the spin stabilization can be utilized for increased projectile velocity in a fin stabilized projectile (or provides for reduced powder requirements to obtain a given projectile velocity of the fin stabilized projectile).

Therefore, there is a need for a fin stabilized projectile which can be employed within a cartridge delivery system, such as those cartridges used with handheld firearms, shoulder-fired weapons such as Carl-Gustaf® recoilless weapon systems or rocket propelled grenades (RPG) s, as well as with larger caliber munitions such as tank and artillery shells. Current literature suggests that spin stabilized projectiles have a limited Length to Diameter (L/D) ratio, and particularly are limited to (L/D) of less than approximately 6:1. It is believed that fin stabilized projectiles can be configured to exceed the 6:1 L/D ratio of spin stabilized projectiles. Further, it is believed that the stability of fin stabilized (finned projectiles) increases with length, with little to no impact on the associated aerodynamic drag. Since mass typically increases with length of the projectile, there is potential for increased mass at an increased velocity, thereby providing greater impact energies delivered by the projectile.

In assessing the performance of a projectile, a parameter that is often used is a ballistic coefficient (BC). Generally, the BC of a projectile is a numeric representation of the aerodynamic efficiency of the projectile. In one definition, as set forth below, BC is defined as m/(Cd*A). Thus, the BC increases upon any of (i) increasing m (mass), (ii) lowering Cd (drag coefficient), and (iii) lowering A (reference area).

Generally, the present disclosure relates to a projectile for supersonic external ballistics having an increased BC, wherein the projectile includes an elongate body extending along a longitudinal axis from a body leading end to a body trailing (converging) end, the elongate body having a diverging ogival nose segment extending rearward from the body leading end and a converging ogival back segment terminating at the body trailing (converging) end, and the elongate body having a center of mass longitudinally intermediate the body leading end and the body trailing (converging) end; and a tail segment including a first tail fin extending radially outward from the back segment and extending along the longitudinal axis rearward of the body trailing (converging) end. In one configuration, the converging ogival back segment and the first tail fin define an increased pressure zone longitudinally intermediate the body leading end and the body trailing (converging) end. In supersonic flight, the increased pressure zone is located at the body trailing (converging) end and the tail segment. The increased pressure zone reduces a drag on the projectile to increase the BC of the projectile.

The present disclosure further relates to a projectile for supersonic flight upon passing from a bore, the projectile having an elongate body extending along a longitudinal axis from a leading end to a trailing end, the elongate body having a diverging ogival nose section extending rearward from the leading end, a converging ogival back section terminating at the trailing end; and a first tail fin projecting radially from the back section and extending longitudinally forward of the trailing end of the elongate body and extending longitudinally rearward of the trailing end of the elongate body.

The present disclosure also includes a projectile for supersonic flight upon passing from a bore, the projectile having an elongate body extending along a longitudinal axis from a leading end to a trailing end, the elongate body having a diverging ogival nose section extending rearward from the leading end, a converging ogival back section terminating at the trailing end; and a tail fin projecting radially from the back section and extending longitudinally forward of the trailing end of the body, wherein the elongate body defines a continuously curvilinear convex profile extending along the longitudinal axis from the leading end to the trailing end.

The disclosure further contemplates a projectile for subsonic flight upon passing from a bore, the projectile having an elongate body extending along a longitudinal axis from a body leading end to a body trailing (converging) end, the elongate body having a diverging ogival nose segment extending rearward from the body leading end and a converging ogival back segment terminating at the body trailing (converging) end, and the elongate body having a center of mass longitudinally intermediate the body leading end and the body trailing (converging) end; and a tail segment including a first tail fin extending radially outward from the back segment and extending along the longitudinal axis rearward of the body trailing (converging) end. In one configuration, the converging ogival back segment and the first tail fin define an increased pressure zone longitudinally intermediate the body leading end and the body trailing (converging) end.

The disclosure also provides a projectile for subsonic flight upon passing from a bore, the projectile having an elongate body extending along a longitudinal axis from a leading end to a trailing end, the elongate body having a diverging ogival nose section extending rearward from the leading end, a converging ogival back section terminating at the trailing end; and a first tail fin projecting radially from the back section and extending longitudinally forward of the trailing end of the elongate body and extending longitudinally rearward of the trailing end of the elongate body.

The present disclosure provides a projectile configured for supersonic flight, and some configurations, supersonic impact, to deliver a greater impact energy than a similarly weighted projectile travelling at subsonic velocity.

BRIEF DESCRIPTION OF THE SEVERAL VIEWS OF THE DRAWING(S)

DETAILED DESCRIPTION OF THE INVENTION

Generally, the present disclosure relates to projectiles for firearms, including projectiles for supersonic flight. As used herein the term "supersonic" in a given medium includes velocities greater than the speed of sound (in the given medium, and at the same temperature and pressure).

While passing a bullet through a rifling imparts gyroscopic stability to the bullet, the process harvests substantial energy otherwise available for increasing the energy of the projectile, as well as impacting the performance of the rifled barrel for subsequent projectiles. That is, as a projectile is shaped by the rifling of the barrel, small amounts of the projectile are worn or dislodged, and these particles can foul the bore surface and rifle landings thereby negatively impact the performance (accuracy) of subsequent projectiles fired through the fouled barrel. Thus, a smooth bore can provide advantages over rifled bores. However, the projectile passing from a smooth bore does not have the gyroscope stability of the rifled projectile.

In one configuration and as will be discussed in greater detail below, the present disclosure provides a projectile configured to generate, at supersonic velocities, a relatively high pressure rearward of the center of mass. The high-pressure zone is located to reduce the drag force on the projectile, and particularly reduce wave drag on the projectile during supersonic flight. That is, by generating a high-pressure zone acting on the projectile at a location to reduce separation of the airflow at supersonic velocities along the projectile body, drag on the projectile is reduced in supersonic flight. The reduced drag increases the efficiency of the projectile at supersonic speeds, which makes the projectile more efficient and effective in delivering energy to the target. Thus, for a given muzzle velocity, the reduced drag on the projectile will result in the projectile reaching the target in less flight time. The reduced flight time reduces exposure of the projectile to environmental variables which can adversely impact the flight of the projectile. Further, reduced flight time reduces the amount of drop experienced by the projectile in traversing the distance from the muzzle to the target. It is further contemplated the projectile can be incorporated into a cartridge without requiring a sabot. That is, the cartridge for retaining and launching the projectile may be sabot-free.

Figure 1A:
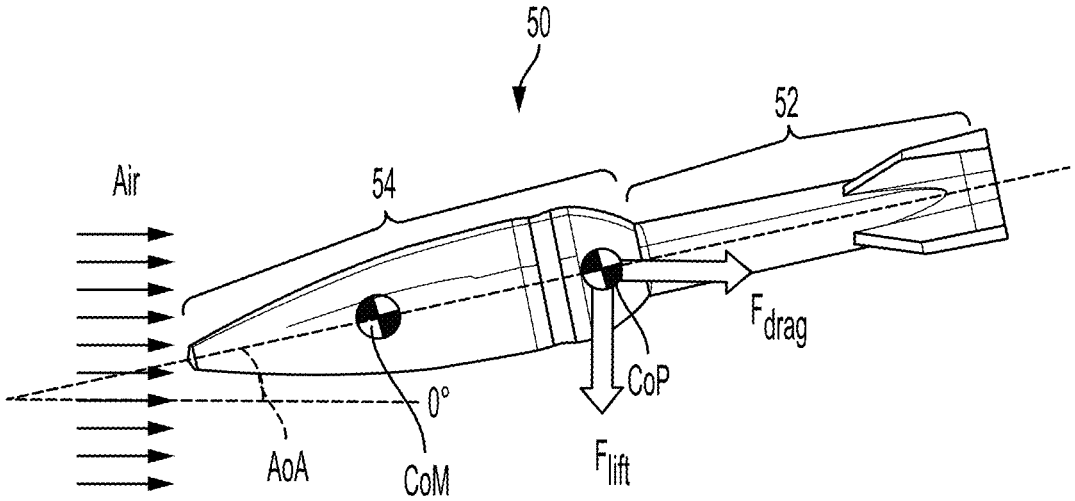
FIG. 1A is a view of a projectile illustrating the fin stabilization theory.
Figure 1:
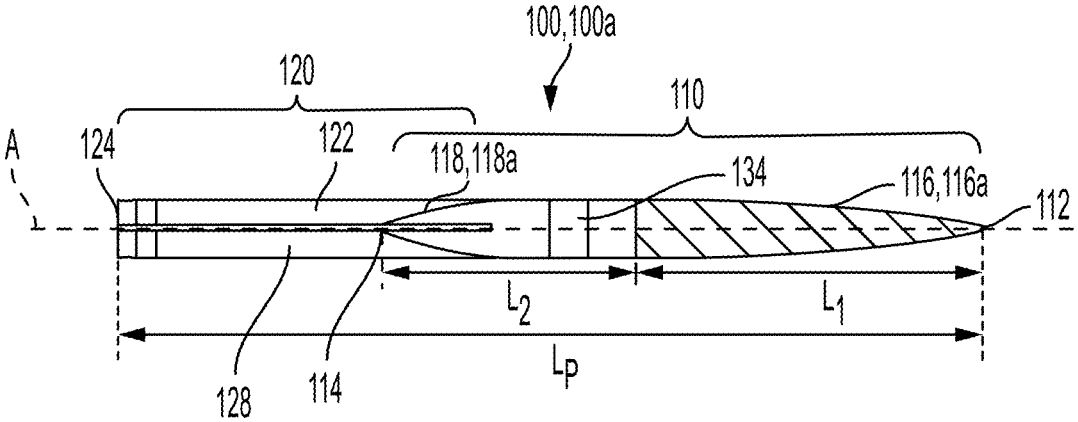
FIG. 1 is a side elevational view of a first configuration of a projectile.
Figure 2:
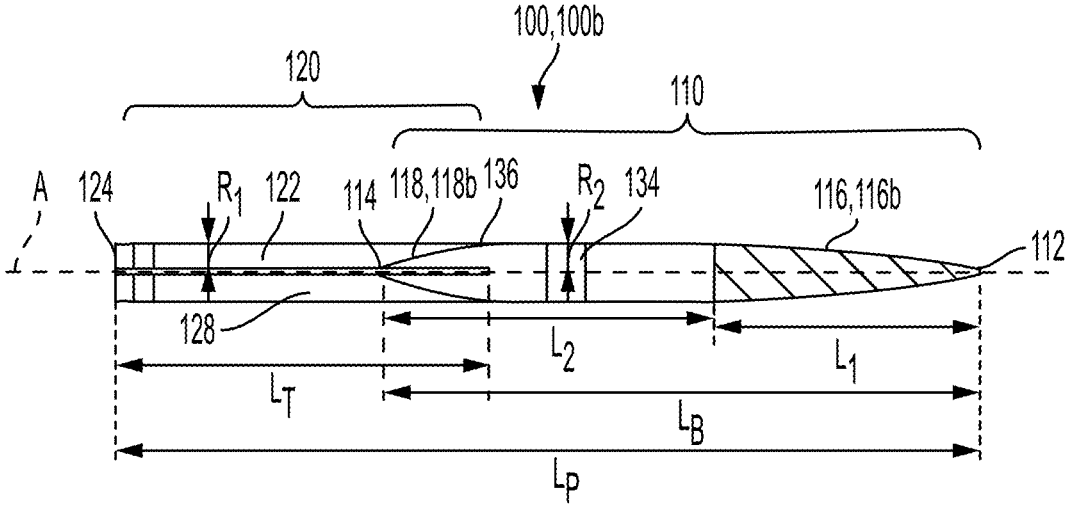
FIG. 2 is a side elevational view of a second configuration of a projectile.
Figure 3:
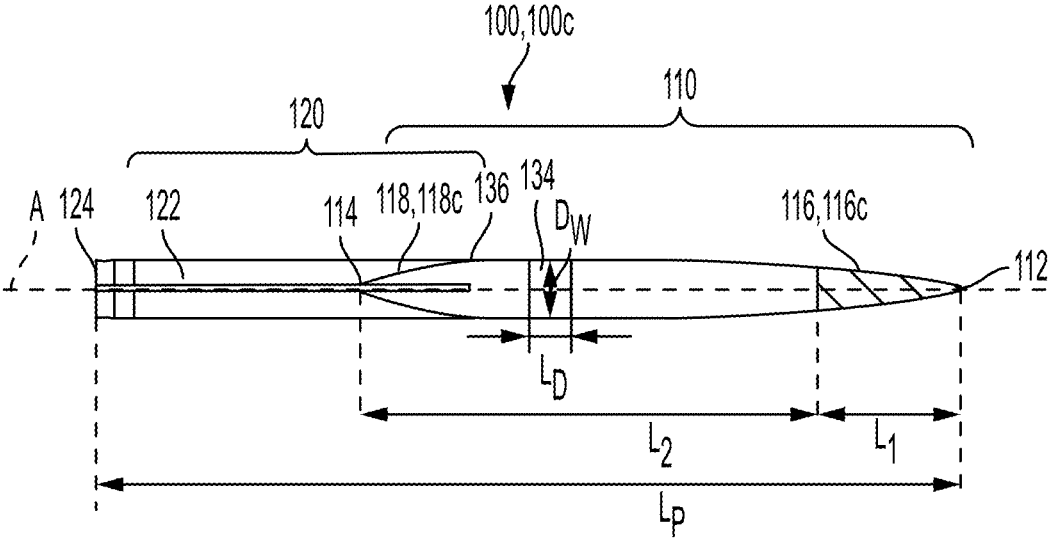
FIG. 3 is a side elevational view of a third configuration of a projectile.

Turning now to FIGS. 1-3, in the present system, exemplary projectiles 100*a*, 100*b*, 100*c* (collectively projectile 100) include an elongate body 110 extending along a longitudinal axis A from a body leading end 112 to a body trailing (converging) end 114. The elongate body 110 includes a diverging ogival nose segment 116 extending rearward from the body leading end 112 and a converging ogival back segment 118 terminating at the body trailing (converging) end 114. The diverging ogival nose segment 116 and the converging ogival back segment 118 are convex from the longitudinal axis A. The ogive (segment 116+ segment 118) is a convex surface, relative to, and extending along the longitudinal axis A. Broadly described, the ogive is the generally curved portion of the projectile 100 from the body leading end 112 to the generally cylindrical portion of the elongate body 110, as well as the generally curved portion of the projectile 100 from the generally cylindrical portion of the elongate body 110 to the body trailing (converging) end 114. In some configurations, the diverging ogival nose segment 116 extends along the longitudinal axis A from the body leading end 112 of the projectile 100 to the portion of the elongate body 110 having the greatest diameter. The converging ogival back segment 118 extends along the longitudinal axis A from the portion of the elongate body 110 having the greatest diameter to the body trailing (converging) end 114.

In select configurations, the ogive of a projectile is characterized by the length of a radius describing the curvature of the ogive along the longitudinal axis, wherein the radius is defined from a point spaced from the longitudinal axis, and is swept about an axis that is transverse to the longitudinal axis. This radius is often given in calibers instead of inches. For example, an 8 ogive 6 mm bullet has an ogive that is a segment of a circular arc with a radius of 8*0.243=1.952". A 0.30-caliber bullet with an 8 ogive will be proportionally the same as the 8 ogive 6 mm bullet, but the actual radius will be 2.464" for the 0.30 caliber bullet.

The ogive can be described in terms of a tangent ogive, a secant ogive, or a hybrid ogive. Generally, a secant ogive provides a more gradual taper relative to its length than does the tangent ogive and provides a higher ballistic coefficient (BC), and thus less drag.

For a given nose length, if an ogive is completely tangent, the curve will have a very specific radius. Any longer radius than the tangent will cause the ogive to be secant. Secant ogives can range from very mild (short radius) to very aggressive (long radius). Generally, the drag of a secant ogive is minimized when the radius, swept from a point spaced from the longitudinal axis and defining the surface, is twice as long as a tangent ogive radius. It is further contemplated that either or both the diverging ogival nose segment and the converging ogival back segment can be tangent ogives, secant ogives, or hybrid ogives having a tangent portion and a secant portion.

As set forth below, in one configuration, the diverging ogival nose segment 116 corresponds to a first solution of a Sears-Haack equation and the converging ogival back segment 118 corresponds to a second solution of the Sears-Haack equation, wherein the first and second solutions can be the same or different solutions.

In one configuration of the elongate body 110, the body leading end 112 and the body trailing (converging) end 114 are generally pointed, though typically having an end defining radius of curvature, wherein the end defining radius of curvature is from a point on the longitudinal axis and swept about an axis that is transverse to the longitudinal axis. It is contemplated the end defining radius of curvature of the body leading end 112 and the body trailing (converging) end 114 are sufficiently small such that the cross-sectional area of each the body leading end and the body trailing end define less than 25% of the maximum diameter of the elongate body, and in certain configurations less than 15%, and further configurations less than 10%. In certain configurations the end defining radius of curvature of the body leading end 112 and the body trailing (converging) end 114 may be the same or may be different. The radius of curvature of the body leading end can be different, and less, than the radius of curvature of the body trailing (converging) end.

With reference to FIGS. 1-3, in one configuration, the elongate body 110 includes a first length $L_1$ extending along the longitudinal axis A and a second length $L_2$ extending along longitudinal axis A, wherein the material comprising the first length $L_1$ has a first density and the material comprising the second length $L_2$ having a different second density. The first length $L_1$ can correspond to the length of the diverging ogival nose segment 116*b* (FIG. 2), be shorter than the diverging ogival nose segment 116*c* (FIG. 3), or longer than the diverging ogival nose segment 116*a* (FIG. 1). Similarly, the second length $L_2$ can correspond to the length of converging ogival back segment 118*b* (FIG. 2), be shorter than the converging ogival back segment 118*a* (FIG. 1), or longer than the converging ogival back segment 118*c* (FIG. 3). Depending upon the materials selected for the first length $L_1$ and the second length $L_2$, the first length $L_1$ can extend between 30% to 60% of the length of the diverging ogival nose segment 116. The second length $L_2$ then extends from end of the first length $L_1$ to the body trailing (converging) end 114, or the terminal end 124 of the tail segment 120 which is described in greater below.

It is further contemplated, the first length $L_1$ of the elongate body 110 can include a payload, and the second length $L_2$ of the elongate body 110 can be free of a payload.

The payload can be an inserted or embedded material of different density than the material of the surrounding portion of the elongate body 110. Alternatively, the payload can be a material of different hardness than the surrounding portion of the elongate body 110. For example, the payload can be a harder material than the surrounding or leading portion of the elongate body 110. Thus, upon impact with a target, a portion of the softer surrounding material of the elongate body 110 accumulates against, or relative to, the target, and the harder payload still retaining the flight velocity impacts the accumulated softer material and then passes through the accumulated softer material into the target, rather than being potentially diverted or glancing from the target. The payload in the first length $L_1$ can correspond to the length of the diverging ogival nose segment 116*b* (FIG. 2), be shorter than the diverging ogival nose segment 116*c* (FIG. 3), or longer than the diverging ogival nose segment 116*a* (FIG. 1).

It is still further contemplated, the first length $L_1$ of the elongate body 110 can include a body outer shell defining an interior cavity. The interior cavity may be left empty or may be configured to include a payload. The second length $L_2$ of the elongate body 110 can be free of a payload. The payload may be a shaped charge or explosive. Thus, upon impact with or near a target, the shaped charge or explosive may detonate thereby inflicting enhanced damage to the target. The payload in the first length $L_1$ can correspond to the length of the diverging ogival nose segment 116*b* (FIG. 2), be shorter than the diverging ogival nose segment 116*c* (FIG. 3), or longer than the diverging ogival nose segment 116*a* (FIG. 1). In another configuration, the second length $L_2$ may define the cavity while the first length $L_1$ includes material having a first density. Second length $L_2$ may then be charged with a payload, such as a shaped charge or explosive. The material having the first density comprising first length $L_1$ may be greater than the density of material(s) comprising the the second length $L_2$ (with or without a payload) such that the center of gravity (CoG) of the projectile is located forward of the center of pressure (CoP) during flight, see e.g., FIG. 1 and discussion thereof, above.

The projectile further includes a tail segment 120 including at least a first tail fin 122 extending radially outward from the elongate body 110 and extending along the longitudinal axis A. In one configuration, the first tail fin 122 extends radially outward from the converging ogival back segment 118 and extends along the longitudinal axis A rearward of the body trailing (converging) end 114 to define a terminal end 124 of the projectile 100.

Figure 4:
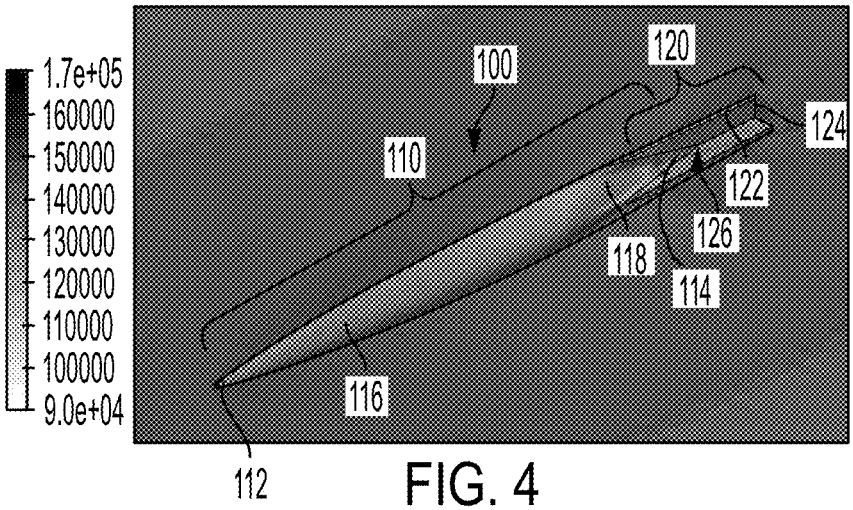
FIG. 4 is a perspective view of an embodiment of the projectile showing relative pressures at a supersonic velocity, wherein the projectile has a longitudinally asymmetric body.

As seen in FIGS. 1-3, with particular reference to FIG. 2, the tail fin 122 can have a radial dimension $R_1$ that is the same as the maximum radial dimension $R_2$ of the elongate body 110. As set forth below, the radial dimension $R_1$ of the tail fin 122 can be from 25% of the maximum radial dimension of the elongate body to 100% of the maximum radial dimension $R_2$ of the elongate body 110. With reference to FIG. 4, the converging ogival back segment 118 of the elongate body 110 and the first tail fin 122 define an increased pressure zone 126 in supersonic flight, wherein the increased pressure zone is located to increase flight stability and/or reduce a drag on the projectile sufficient to increase a BC of the projectile at supersonic velocities. The elongate body 110 and the tail segment 120 can be configured such that the increased (high) pressure zone 126 is adjacent the body trailing (converging) end 114 portion of the converging ogival back segment 118 of the elongate body 110. As set forth above, this increased pressure zone 126 reduces the drag on the projectile 100 at supersonic velocities.

The first tail fin 122 can have a variety of configurations, wherein the fin tapers (thins) as a radial dimension increases. Alternatively or additionally, the first tail fin 122 can have different circumferential dimensions at different positions along the longitudinal axis A. That is, the circumferential dimension of the first tail fin 122 can vary along the longitudinal dimension of the projectile 100. Further, in one configuration, the first tail fin 122 is substantially planar as it extends radially and longitudinally. Further, the first tail fin 122 can extend longitudinally parallel to the longitudinal axis A or can be inclined relative to the longitudinal axis A thereby defining a helical shape. In one configuration, the first tail fin 122 defines a rear or terminal end 124 of the projectile 100. That is, as seen in at least FIGS. 1-3, the first tail fin 122 extends rearward beyond the body trailing (converging) end 114 of the elongate body 110 so as to define a terminal end 124 of the projectile 100.

Figure 5:
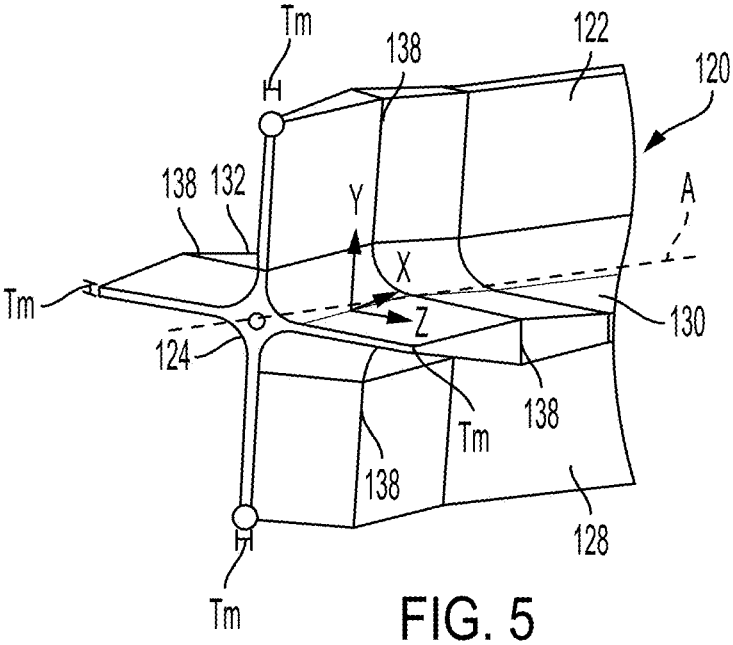
FIG. 5 is a rear end perspective view of the trailing end of the tail segment of a projectile.

As shown most clearly in FIG. 5, tail segment 120 can further include a second tail fin 128, a third tail fin 130, and a fourth tail fin 132, wherein the first tail fin 122, the second tail fin 128, the third tail fin 130, and the fourth tail fin 132 are symmetrically disposed about the longitudinal axis A. However, it is contemplated the tail fins 122, 128, 130, 132 can be asymmetrically located about the circumference of the elongate body 110. Further, the number of tail fins is not limited to four.

In addition, in a further configuration, the first tail fin 122 may be defined by a first maximum radial dimension and the second tail fin 128 defined by a different second maximum radial dimension. It is further contemplated the radial dimension of the first tail fin 122 can vary along the longitudinal axis A, the first tail fin 122 has a minimum radial dimension that is at least 75% of a maximum radial dimension of the first tail fin 122. In a further configuration, at least 75% of the length of the first tail fin along the longitudinal axis has a radial dimension that is at least 75% of the maximum radial dimension of the elongate body.

With reference to FIGS. 1-3, and FIG. 2 in particular, first tail fin 122 can extend longitudinally rearward from a leading edge 136 of the first tail fin 122, wherein a ratio of the length $L_T$ of the first tail fin 122 along the longitudinal axis A to a length $L_B$ of the elongate body 110 along the longitudinal axis A is between 0.15 to 2.0, and in a further configuration the ratio is between 0.19 and 1.6. In some configurations, the length of the tail fins along the longitudinal axis between the body trailing (converging) end and the terminal end of the projectile is between 25% and 50% of the overall length of the projectile. The length of the tail fin along longitudinal axis from the leading edge of the tail fin projecting from the converging ogival back segment to the terminal end of the tail fin is between 40% to 60% of the overall length of the projectile.

As seen in FIGS. 1-3, the tail segment 120 can include the first tail fin 122 and a second tail fin 128, wherein each of the first tail fin 122 and the second tail fin 128 extend radially outward from the back segment 118 of the elongate body 110 and extend along the longitudinal axis A to terminate rearward of the body trailing end 114, thereby defining a terminal end 124 of the projectile 100. A further configuration, not shown, may include a fin extending radially from the diverging ogival nose segment 116, and longitudinally forward of the body leading end 112. Although not shown, similar, to the description of the number, shape, and configuration of the tail fins, the head fins can exhibit the same characteristics.

Figure 6:
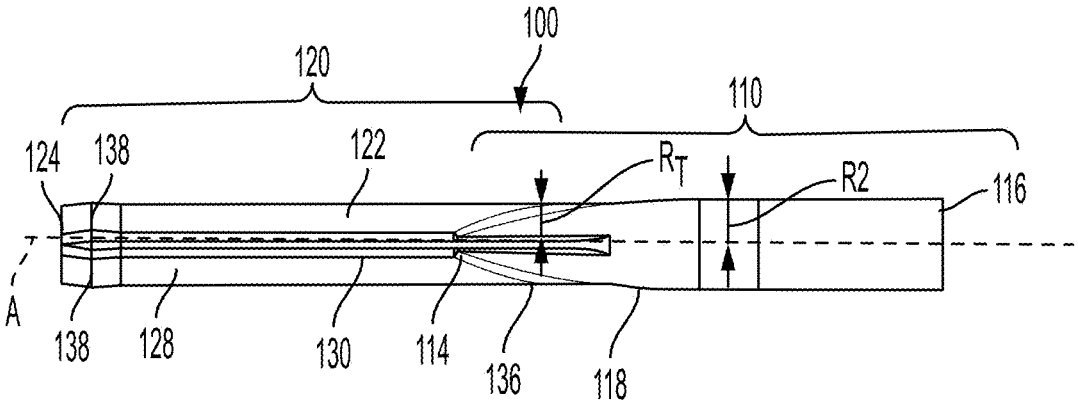
FIG. 6 is a side elevational view of an alternative tail segment of the projectile.

As seen in the FIG. 6, the four tail fins may be defined by the same parameters, wherein each tail fin 122, 128, 130, 132 begins at a respective leading end 136 on the converging ogival back segment 118 of the elongate body 110 at a radius $R_T$ that is less than the maximum radius $R_2$ of the elongate body 110. The location of the leading edge of the tail fin is between 60% and 98% of the radius of the elongate body at that longitudinal position. The tail fins are substantially planar as they extend radially and longitudinally.

The tail fins 122, 128, 130, 132 have a generally constant cross section, transverse to the longitudinal axis A, from body trailing (converging) end 114 to adjacent the terminal end 124 of the tail segment 120. As seen in FIGS. 5 and 6, proximal to the terminal end 124 of the tail segment 120, the tail fins 122, 128, 130, 132 define a respective bulge, or bulbous portion, 138 transverse to the longitudinal axis A, wherein the bulge 138 defines a maximum dimension of the tail fin that is transverse to the longitudinal axis, and the tail fin then tapers to a minimum thickness $T_m$ at the terminal end 124 of the tail segment 120. In addition, the bulge 138 can increase the radial dimension of the fin 122, 128, 130, 132 to define a maximum radial dimension of the tail fin. In one configuration, the radial dimension of the bulge 138 is less than the radial dimension of the elongate body 110.

It is contemplated the tail fins can include a canting or longitudinal variation to impart a spin of the projectile about the longitudinal axis. Rotation of the projectile about the longitudinal axis also can be imparted by helical grooves in the elongate body (wherein the grooves are not the bearing surface and not formed by contact with the bore). It is further contemplated the rotation of the projectile about the longitudinal axis could be imparted by surface features, including but not limited to protrusions, recesses, ridges, or grooves on the diverging ogival nose segment (wherein the surface features are not the bearing surface and are not formed by contact with the bore). These imparted spins are not on the order of typical prior spin rates, but rather typically less than 25,000 rpm, and in select configurations less than 2,500 rpm.

A benefit of imparting this rotation about the longitudinal axis is to normalize the flight characteristics of the projectile with respect to anticipated manufacturing variations. That is, the imparted spin can dominate the effective on the flight characteristics of the projectile from manufacturing tolerances, thereby providing more consistent flight characteristics between projectiles. Thus, the projectile can include a surface feature longitudinally intermediate the body leading end and the terminal end, wherein the surface feature induces a rotation of the projectile about the longitudinal axis, wherein the surface feature is part of the manufactured projectile and exists prior to passage along the bore (that is, the surface feature is not formed by contact with the bore), and wherein the imparted rate of rotation is less than 25,000 rpm, and in select configurations less than 2,500 rpm.

Figure 7:
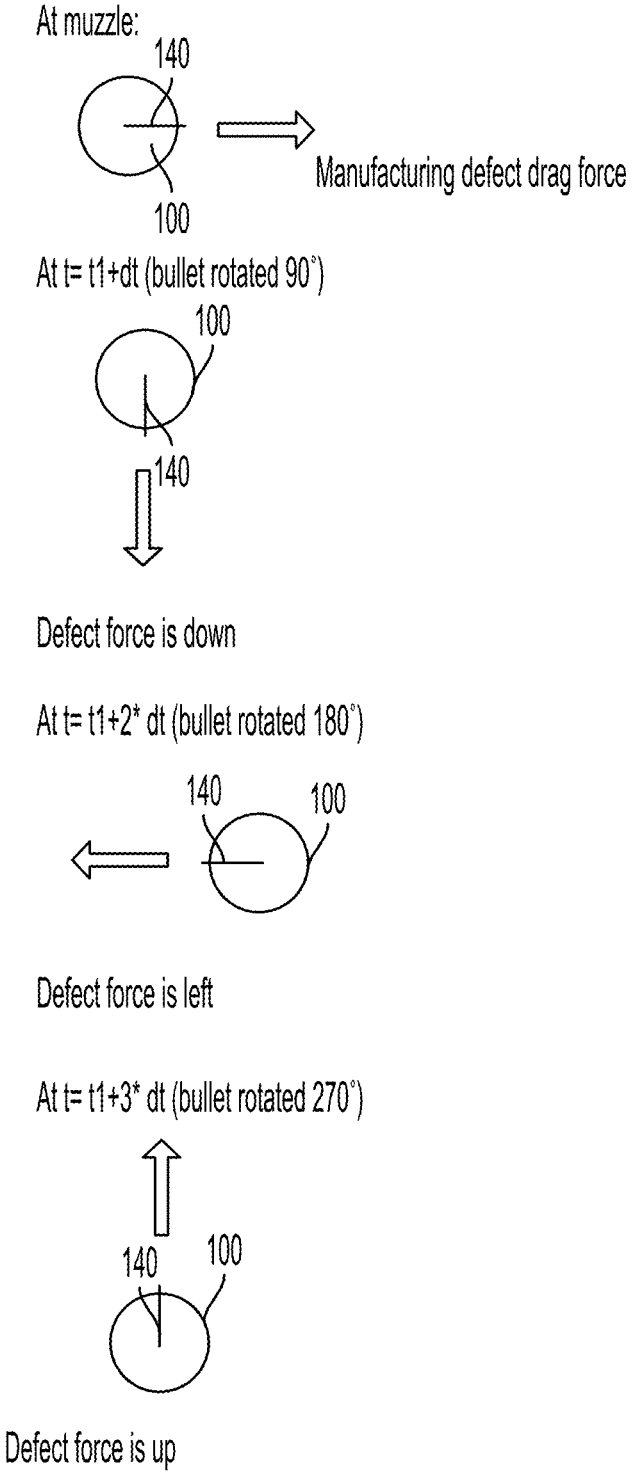
FIG. 7 is a series of schematic representations of an unbalanced defect force acting on a projectile in flight during a non-gyroscopically stabilizing imparted rotation of the projectile.

With reference to FIG. 7, in this imparted rotation, if a defect 140 creates an unbalanced defect force on the projectile 100 in flight, the imparted rotation will cause this unbalanced defect force to "rotate" about the projectile, thereby essentially cancelling out the impact of unbalanced defect force. That is, if there were no rotation, the unbalanced defect force would continue acting in the same direction on the projectile for the entire flight. However, by imparting a rotation as represented in FIG. 7, the action of the unbalanced defect force is distributed about the projectile as the projectile rotates, wherein the projectile thus travels a "spiral graph" wherein a diameter of the spiral depends in part on the magnitude of the unbalanced defect force and the rate of rotation.

Figure 8:
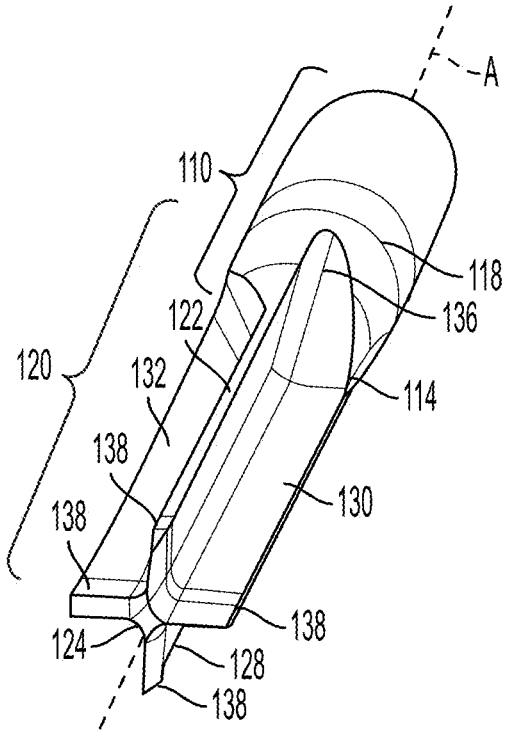
FIG. 8 is a rear perspective view of an alternative configuration of the tail segment.
Figure 9:
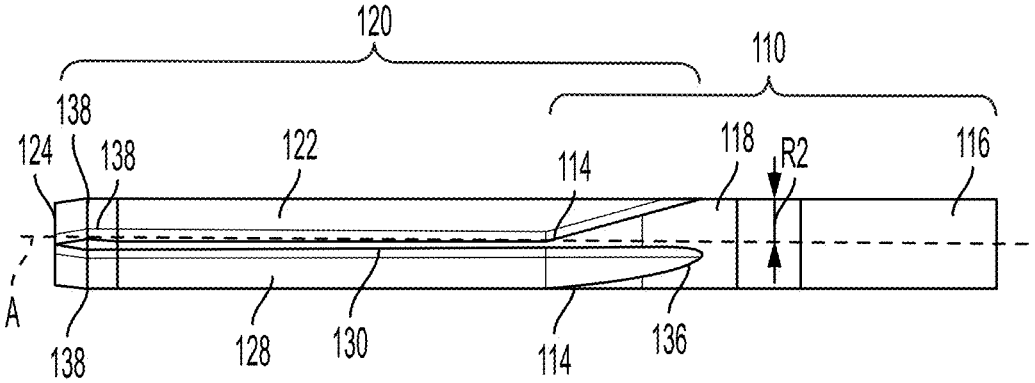
FIG. 9 is a side elevational view of the tail segment of FIG. 8.
Figure 10:
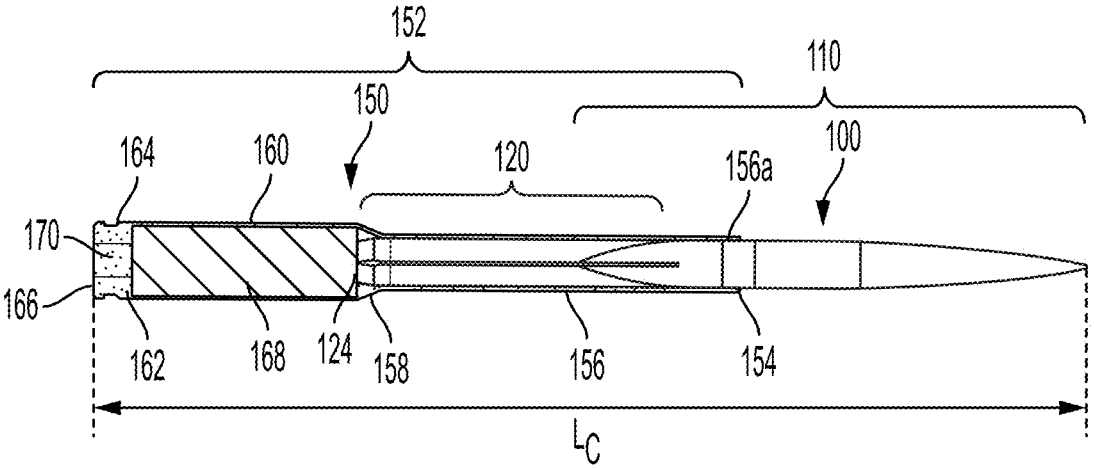
FIG. 10 is a cross-sectional side elevational view of the configuration of the projectile in a casing with a charge forming a cartridge.
Figure 11:
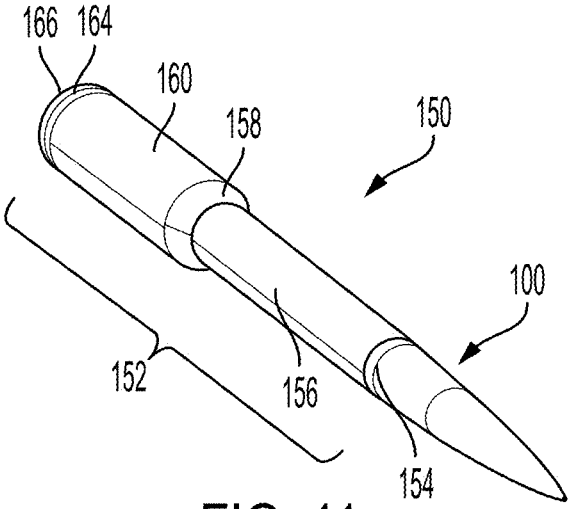
FIG. 11 is a perspective view of the cartridge of FIG. 10.
Figure 12:
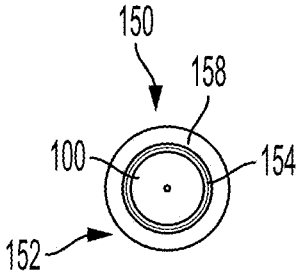
FIG. 12 is a front elevational view of the cartridge of FIG. 10.

As seen in FIGS. 8 and 9, the radius of the tail fins at the leading edge 136 at the point the radially extend from the converging ogival back segment 118 is less than the maximum radius of the elongate body 110. As the tail fins 122, 128, 130, 132 extend rearward, the tail fins achieve a maximum radius at the longitudinal position of the body trailing (converging) end 114. The radial dimension of the tail fins remains constant along the longitudinal axis A until the bulge 138, where the radial dimension increases, while still remaining less than the maximum radial dimension $R_2$ of the elongate body 110.

Bulge 138 on the tail fins 122, 128, 130, 132 is configured to increase local drag by an amount sufficient to increase stability at low angles of attack of the projectile. In addition, the increased radial dimension of the bulge decreases the gap between the tail fin and the bore, thereby reducing the amount of travel (or lever moment) the tail fin can generate to act on the elongate body. In addition, the bulge can be configured to impart the canting, or sub gyroscopic stabilization rotation of the projectile.

Returning to FIGS. 1-3, elongate body 110 can be continuously curvilinear along the longitudinal axis A between the leading end 112 and the converging end 114. In particular, in one configuration, the elongate body 110 can define a convex surface relative to the longitudinal axis A from the leading end 112 to the trailing converging end 114 of the elongate body 110. The continuously curvilinear profile of the elongate body 110 includes a radius from a point spaced from the longitudinal axis A, wherein the radius is laterally spaced from the longitudinal axis by a multiple of times, e.g., 10 to 20× the length $L_P$ of the projectile 100. For example, if the projectile is 2.5 inches long, then the axis of rotation of the defining radius may be 25 to 50 inches from the longitudinal axis. It is further contemplated portions of the ogive profile along the longitudinal axis can be defined by a corresponding plurality of radii rotating about points spaced from the longitudinal axis. That is, the diverging ogival nose segment 116 can be defined by a first radius (or set of radii) and the converging ogival back segment 118 defined by a different second radius (or set of radii).

It is understood the term continuously curvilinear encompasses surface variations including but not limited to discontinuities, segmented, or even linear or faceted portions, wherein such surface variations are subsumed within the macro curvilinearity of the projectile. For example, the surface of the projectile could be defined by sawtooth surface features, wherein the sawtooth features are located along the curvilinear profile of the projectile. Continuously curvilinear encompasses surface variations that are typically of a smaller dimension that the boundary layer (or viscous sublayer) along the local surface of the projectile.

It is further contemplated the elongate body 110 can include a waist segment 134 extending along the longitudinal axis A intermediate the nose segment 116 and the back segment 118, wherein the waist segment 134 defines a maximum diameter $D_W$ (e.g., $2\times R_2$) transverse to the longitudinal axis A of the elongate body 110. See FIG. 3. In one configuration, the waist segment 134 can define a bearing surface with the surface 202 of the bore defined by barrel 200 (see FIG. 13). The bearing surface is that portion of the projectile 100 which comes into contact with the surface of bore 202 of the barrel 200.

The waist segment 134 can be a cylindrical section of the elongate body 110 or can be defined by an arc, extending parallel to the longitudinal axis A, having a curvature defined by a radius that is greater than a radius defining the curvature of at least one of the nose segment 116 and the back segment 118, and in certain configurations the radius of curvature of the waist segment 134 is at least 1.1 times the radius of curvature of the diverging nose segment 116 or the converging back segment 118. It is understood the radius of curvature of the waist segment 134 may be at least 1.2 to 20 times the radius of curvature of the diverging nose segment 116 or the converging back segment 118. In one configuration the waist segment 134 defines a cylinder having a longitudinal dimension $L_D$ between 0.1 inches and 0.4 inches.

The distance of the waist segment 134 from the longitudinal axis A along the length of the waist segment 134 may vary by less than 10%, and in certain configurations, less than 5% and in further configurations less than 1%. That is, the radius of curvature of the waist segment 134 along an arc that is parallel to the longitudinal axis A can define a substantially constant diameter along the longitudinal axis A. In certain configurations, waist segment 134 forms a bearing surface between the projectile 100 and the surface of bore 202 defined by barrel 200. That is, the elongate body 110 defines a first circumferential bearing surface configured to contact a surface of the bore 202.

In one specific configuration, the profile of the elongate body 110 is defined by the Sears-Haack equation, discussed below. The reduced wave drag of the Sears-Haack projectile body allows the projectile to travel farther in-flight distances, thereby engaging targets at increased distances. In addition, the Sears-Haack body results in a reduced turbulence which can improve the accuracy of projectile.

A Sears-Haack body is an axisymmetric body with minimum wave drag (at transonic speeds) derived theoretically from linearized potential flow equations, first described by Wolfgang Haack in 1941 and later by William Sears in 1947. Wolfgang Haack further proposed a general formula for a series of axisymmetric bodies with low drag for given length and maximum diameter. A special case of the Haack Series is the Von Karman Ogive (for C=0) which gives a body with the least wave drag even at supersonic and hypersonic speeds.

Sears and Haack found that the wave drag of a body is proportional to the second derivative of the cross-sectional area distribution along the direction of freestream velocity. This means that the body area distribution has to be smooth, have no jumps in its derivatives, and be of a certain shape for minimal wave drag. By assuming a slender, axisymmetric body and linearized supersonic flow, a single shape is found that has the lowest wave drag for a given volume and length, described by Equation (1):

$$r(x) = R_{max}(4x\{1-x\})^{0.75} \tag{1}$$

wherein x ($0 \le x \le 1$) is the non-dimensional, axial distance from the nose scaled by the body length (L), r(x) is the dimensional, cross-sectional radius, and $R_{max}$ is the maximum radius of the body, which can be found for any given body length and volume (Vol) from the relationship of Equation (2):

$$Vol = \frac{3\pi^2 R_{max}^2 L}{16} \tag{2}$$

In one configuration, the elongate body is a Sears-Haack body having the lowest theoretical wave drag in supersonic flow, for a given body length and given volume. However, it is recognized that the body may not be completely defined by the Sears-Haack equation.

In one configuration, the diverging ogival nose segment and the converging ogival back segment of the elongate bullet are defined by the Sears-Haack equation. In a further configuration, the diverging ogival nose segment corresponds to a first solution of the Sears-Haack equation and the converging ogival back segment corresponds to a second solution of the Sears-Haack equation, wherein the first and second solutions can be the same or different solutions. Specifically, it is contemplated the first solution and the second solution are different.

Generally, drag at supersonic speeds includes the drag components at subsonic flow conditions (skin friction drag and induced drag) and a wave drag which is only a characteristic in supersonic flows. The wave drag is due to the energy radiated by the aerodynamic system through the shock waves.

The ballistic coefficient (BC) of a projectile is a measure of the ability of the projectile to overcome air resistance in flight. A high BC indicates that the projectile is aerodynamically efficient. Aerodynamic efficiency means that the projectile will retain its velocity for longer and travel farther. Bullets with high BCs are often used for long-range shooting, where accuracy is critical.

In one definition, BC is defined by Equation (3):

$$BC = \frac{m}{C_d A} \tag{3}$$

wherein m is the mass of the projectile; A is the cross-sectional area of the projectile; and $C_d$ is a drag coefficient defined by Equation (4), $$C_d = \frac{2F_d}{-\rho_d u^2 A} \tag{4}$$

wherein $F_d$ is the drag force; $\rho_d$ is the mass density of the fluid passing the projectile; u is the flow speed of the projectile relative to the fluid; and A is the reference area of the projectile.

It is understood, the above equation can be simplified by assuming the projectile is a cylinder, and the BC equation reduces to Equation (5) as follows:

$$BC = \frac{m}{C_d A} = \frac{\rho_c l}{c_d} \tag{5}$$

wherein $\rho_c$ is the spatial average density of the cylindrical projectile; and l is a length of the cylinder.

The simplification of Equation (5) illustrates that the BC is a function of projectile length, rather than the radius of the projectile for a given drag coefficient $C_d$. Therefore, while recognizing there are additional countervailing factors, there can be a benefit to increasing the length of the projectile.

As suggested in the description of the payload as set forth above, the elongate body can include the first length formed of a first material and the second length formed of a second material, wherein the first length and the second length are integral (or monolithic) thereby precluding non-destructive separation during flight or upon impact with a target. Similarly, the elongate body and the tail segment can be formed of different materials, such as different density or hardness. It is contemplated the projectile is an integral one piece or monolithic construction, wherein the separate materials are bonded or connected to preclude non-destructive separation during flight or upon impact with a target.

As further suggested in the description of the payload as set forth above, the elongate body can include the first length formed of a first material and the second length formed of a second material, wherein the first length and the second length are integral (or monolithic) thereby precluding non-destructive separation during flight but that are configure to separate, detonate, or otherwise deform upon impact with a target thereby causing additional damage to the target. Similarly, the elongate body and the tail segment can be formed of different materials, such as different density or hardness. It is contemplated the projectile is an integral one piece or monolithic construction, wherein the separate materials are bonded or connected to preclude non-destructive separation during flight or upon impact with a target.

It is also contemplated that the projectile can include layered materials of different compositions, hardness, or density. The layered materials can be obtained by any of a variety of mechanisms such as, but not limited to coating, plating, dipping, deposition, spraying, or any combination thereof. It is further contemplated that the projectile can include composite materials, such as but not limited to one or more of carbon-based composites, ceramics, or glass reinforced polymers.

Having thus described various embodiments of a projectile 100, FIGS. 10-14 shown an exemplary embodiment of a cartridge 150 having a casing 152 configured to retain and selectively fire the projectile 100 therefrom when triggered. In an exemplary embodiment, the casing 152 can be a standard casing configuration, such as a 0.308 casing, having a mouth 154, a neck 156, a shoulder 158, a closed ended generally cylindrical case body 160, a primer pocket 162, an extractor groove 164, and a head 166 defining the closed end. The mouth 154 is the open end of cartridge 150 that passes a portion of the projectile 100 and evolved gasses upon firing. The neck 156 is the reduced diameter cylindrical portion of the casing 152 that extends from the shoulder 158 to the mouth 154. The neck 156 typically includes a portion **156*a* crimped about the periphery of the projectile 100. The shoulder 158 is the portion of the casing 152 that tapers from neck 156 to the diameter of the case body 160. The case body 160 houses the propellant 168. The primer pocket 162 retains the primer 170. The extractor groove 164 is a surface feature on the exterior of casing 152 that is engaged by the firing mechanism of the firearm for the removal of the spent casing from the firearm. The head (closed end) 166 is the end of the cartridge 150 in which the primer 170** is inserted and the surface upon which the headstamp identification is printed.

Figure 13:
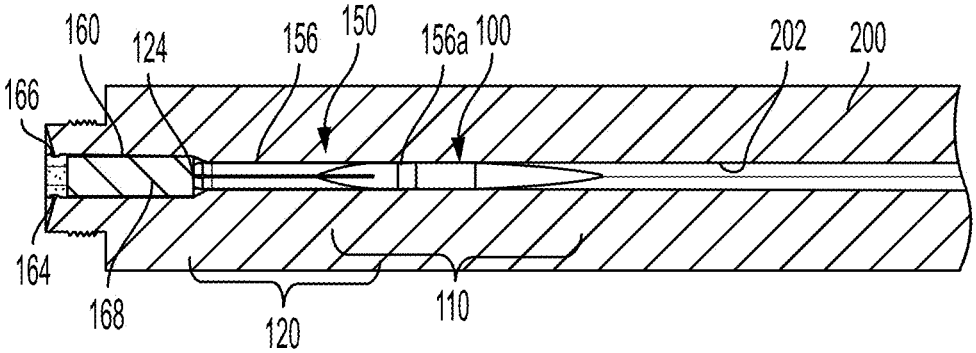
FIG. 13 is cross sectional side elevational view of the cartridge of FIG. 10 operably located within a barrel.
Figure 14:
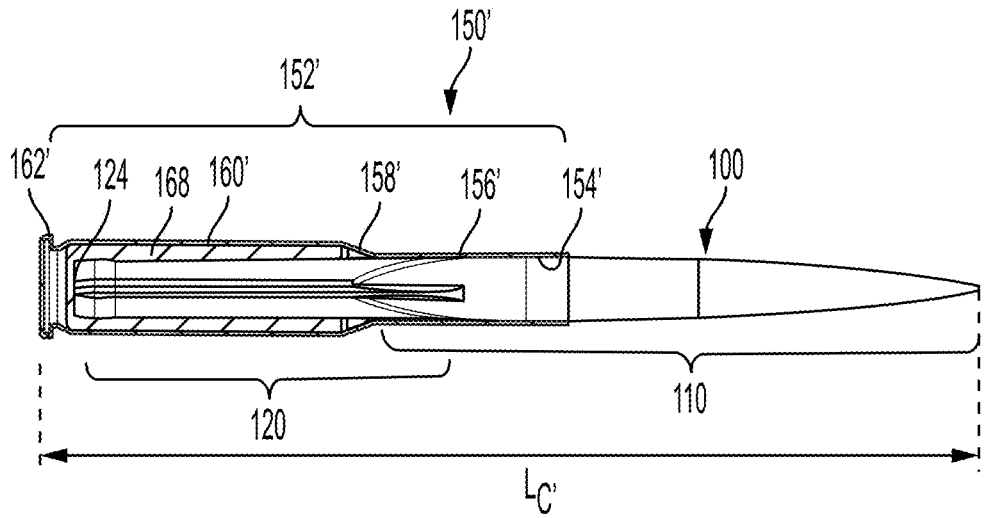
FIG. 14 is a cross-sectional side elevational view of an alternative configuration of the projectile in a casing with a charge forming a cartridge.

As shown in FIG. 13, cartridge 150 may define a cartridge length Lc whereby terminal end 124 of projectile 100 may reside generally within the open volume defined by shoulder 158', with substantially the entirety of case body 160 housing propellant 168. Alternatively, in another configuration shown in FIG. 14, cartridge 150' may include a casing 152' and define a cartridge length Lc' whereby terminal end 124 of projectile 100 passes through mouth 154' and resides case body 160' along with propellant 168, and terminal end 124 may be located proximate to head 162'. Neck 156' may thus have a shorter length than neck 156, with cartridge length Lc' being less than cartridge length Lc.

Although the primer, sometimes referred to as a primer packet, is shown at the closed end of the casing, it is contemplated the primer may be longitudinally spaced from the closed end of the case body. For example, the primer may extend longitudinally along the case body, to have a length at least equal to the diameter of the case body, and in certain configurations, multiples of the length of the case body. Alternatively, the primer can extend radially inward from the case body at a longitudinal position spaced from the closed end. It is contemplated the primer can be located anywhere along the longitudinal axis intermediate the neck and the closed end of the case body. Thus, in contrast to conventional cartridges in which the primer is located at the closed end of the case body and the propellant powder to be ignited is forward of the primer, the present cartridge contemplates the primer being positioned to locate a portion, and in certain configurations a majority of the propellant powder rearward of the primer. It is further contemplated the primer can be formed as a disk shape or an annular ring that is oriented transverse to the longitudinal axis and longitudinally spaced from the closed end.

Figure 15:
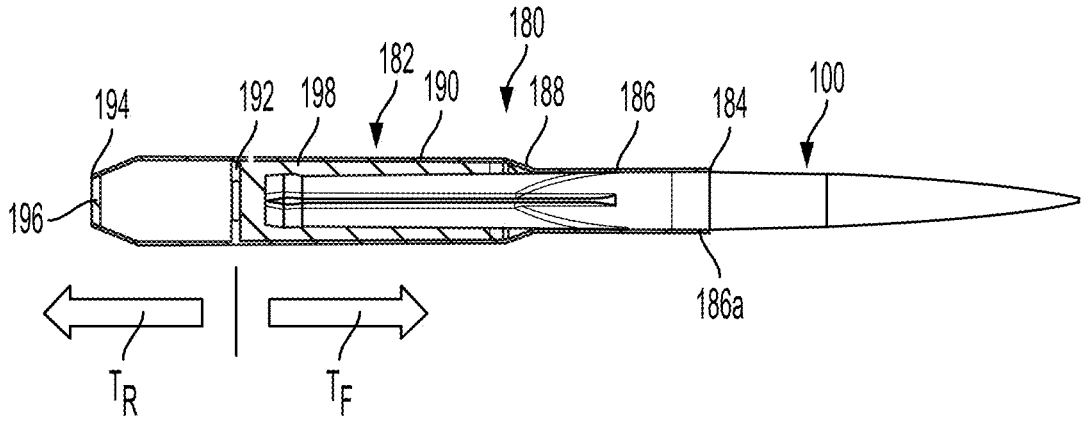
FIG. 15 is a cross-sectional side elevational view of another alternative configuration of the projectile in a casing with a charge forming a cartridge.

With reference to FIG. 15, an alternative exemplary embodiment of a cartridge 180 having a casing 182 configured to retain and selectively fire the projectile 100 therefrom when triggered. In an exemplary embodiment, casing 182 can be a casing configured for recoilless weapons systems, such as a Carl-Gustaf® weapon system or other shoulder-fired munition, such as an RPG. Casing 182 includes a mouth 184, a neck 186, a shoulder 188, a generally cylindrical case body 190, a primer disk 192, and a head 194 defined by a rupturable burst disk/displaceable blowout base 196. The mouth 184 is the open end of cartridge 180 that passes a portion of the projectile 100 and evolved gasses upon firing. The neck 186 is the reduced diameter cylindrical portion of the casing 182 that extends from the shoulder 188 to the mouth 184. The neck 186 typically includes a portion **186*a* crimped about the periphery of the projectile 100. The shoulder 188 is the portion of the casing 182 that tapers from neck 186 to the diameter of the case body 190. The case body 190 houses the propellant 198. The primer disk 192 is engaged by the firing mechanism of the firearm so as to ignite propellant 198. Primer disk 192 may initiate combustion of propellant 198 such as via percussion ignition or other delivery of hot gas to propellant 198, or via mechanical impact with chemical primers or via provision of electrical charge. A first portion of the gases evolved by the ignited propellant 198 operates to provide forward thrust $T_F$ to projectile 100 to fire projectile 100 from casing 182 while a second portion of the gases provides sufficient force to burst disk/displaceable blowout base 196 to cause burst disk/displaceable blowout base 196 to rupture/dislodge or otherwise open head 194 and expel the second portion of the gases rearward $T_R$ from cartridge 180 (and the weapon system employing cartridge 180**). This rearward dissipation of gases provides for recoilless firing the of the shoulder-mount firearm.

It is contemplated the firing pin for such primer locations could be dynamic (moveable from a retracted position to a firing position) or static (wherein the cartridge is forced against the static firing pin) to ignite the primer. Specifically, the casing can be configured to be operably received, fired, and ejected from standard firearm configurations, such as but not limited to 0.308 or 7.62 NATO cartridges.

This disclosure has been described in detail with particular reference to an embodiment, but it will be understood that variations and modifications can be affected within the spirit and scope of the disclosure. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed:

1. A projectile for passing from a bore, the projectile comprising:

(a) an elongate body extending along a longitudinal axis from a body leading end to a body trailing (converging) end, the elongate body having a diverging ogival nose segment having a first radius of curvature extending rearward from the body leading end and a converging ogival back segment having a second radius of curvature terminating at the body trailing (converging) end, and wherein the elongate body defines a maximum radial dimension; and (b) a tail segment including a first tail fin rigidly formed on the tail segment, the tail segment extending radially outward from the converging ogival back segment and extending along the longitudinal axis rearward of the body trailing (converging) end to terminate at a terminal end longitudinally spaced from the body trailing (converging) end, wherein the Tail segment has a fin radial dimension between about 25% and 100% of the maximum radial dimension of the elongate body during flight of the projectile.

2. The projectile of claim 1, wherein the tail segment and the converging ogival back segment define a high pressure zone adjacent the body trailing end of the elongate body.

3. The projectile of claim 1, wherein the first tail fin is substantially planar.

4. The projectile of claim 1, wherein the converging ogival back segment and the first tail fin define an increased pressure zone in flight, wherein the increased pressure zone is located rearward of a center of mass of the elongate body and reduces a drag on the projectile to increase a ballistic coefficient of the projectile.

5. The projectile of claim 1, wherein the first tail fin extends longitudinally parallel to the longitudinal axis and the first tail fin defines a radius between 75% and 100% of a maximum radius defined by the elongate body.

6. The projectile of claim 1, wherein the first tail fin extends rearward along the longitudinal axis and includes a leading edge located a spaced distance rearward of the body trailing (converging) end.

7. The projectile of claim 1, further comprising a second tail fin, a third tail fin and a fourth tail fin, wherein the first tail fin, the second tail fin, the third tail fin, and the fourth tail fin are symmetrically disposed about the longitudinal axis.

8. The projectile of claim 1, further comprising a waist segment extending along the longitudinal axis intermediate the nose segment and the back segment, wherein the waist segment defines the maximum radius of the elongate body.

9. The projectile of claim 8, wherein the first tail fin extends rearward along the longitudinal axis and includes a leading edge located at the body trailing (converging end), the waist segment, or between the body trailing (converging) end and the waist segment.

10. The projectile of claim 1, wherein at least 75% of a length of the first tail fin along the longitudinal axis is at least 75% of the maximum radius of the elongate body.

11. The projectile of claim 1, wherein the elongate body includes a payload extending along the longitudinal axis, wherein the payload has at least one of a different density and a different hardness than a portion of the surrounding elongate body.

12. The projectile of claim 1, wherein the elongate body includes a first length extending along the longitudinal axis and a second length extending along longitudinal axis, the first length having a first mass and the second length having a different second mass.

13. The projectile of claim 1, wherein a ratio of a length of the tail segment along the longitudinal axis to a length of the elongate body along the longitudinal axis is between 0.15 to 2.0.

14. The projectile of claim 1, wherein the elongate body is continuously curvilinear along the longitudinal axis from the elongate body leading end to the elongate body trailing end.

15. The projectile of claim 1, wherein the tail segment extends along the longitudinal axis from converging ogival back segment to terminate at a rear end longitudinally spaced from the body trailing end.

16. The projectile of claim 1, wherein the first tail fin has a minimum radius that is at least 75% of a maximum radius of the first tail fin.

17. The projectile of claim 1, wherein the diverging ogival nose segment corresponds to a first solution of a Sears-Haack equation and the converging ogival back segment corresponds to a second solution of the Sears-Haack equation.

18. The projectile of claim 17, wherein the first solution and the second solution are different.

19. The projectile of claim 1, wherein the diverging ogival nose segment and the converging ogival back segment are convex from the longitudinal axis.

20. The projectile of claim 1, wherein the tail segment includes the first tail fin and a second tail fin, each of the first tail fin and the second tail fin extending radially outward from the back segment and extending along the longitudinal axis to terminate rearward of the body trailing end.

21. The projectile of claim 1, wherein the elongate body defines a first circumferential bearing surface configured to contact a surface of the bore.

22. The projectile of claim 1, wherein the first tail fin includes a fixed bulge proximal to the terminal end.

23. The projectile of claim 1, wherein the first tail fin includes a canting configured to impart a spin to the projectile about the longitudinal axis.

24. The projectile of claim 1, wherein the converging ogival back segment and the first tail fin define an increased pressure zone in supersonic flight.

25. The projectile of claim 1, wherein the elongate body and the tail segment are monolithic.

26. The projectile of claim 1, wherein the elongate body includes a first length formed of a first material and a second length formed of a second material, the first length and the second length being integral precluding non-destructive separation (are monolithic) during flight and following impact of the projectile.

27. The projectile of claim 1, wherein the elongate body includes a first length formed of a first material and a second length formed of a second material, the first length and the second length precluding non-destructive separation (are monolithic) during flight and are configured to separate following impact of the projectile.

28. The projectile of claim 27, wherein the first length of the elongate body defines a cavity.

29. The projectile of claim 28, wherein the cavity is configured to receive one or more of the second material, a third material being different than the first material and the second material, a shaped charge, and an explosive.

30. The projectile of claim 1, further comprising a waist segment longitudinally intermediate the diverging ogival nose segment and the converging ogival back segment.

31. The projectile of claim 1, further comprising a waist segment longitudinally intermediate the diverging ogival nose segment and the converging ogival back segment, wherein the waist segment defines a constant diameter along the longitudinal axis.

32. The projectile of claim 1, further comprising a casing enclosing a portion of the elongate body, the casing releasably engaging the elongate body longitudinally intermediate the body leading end and the body trailing (converging) end.

33. The projectile of claim 32, wherein the casing includes a closed end having a primer, wherein the casing holds a propellant between the primer and the portion of the elongate body engaged by the casing whereby triggering of the primer ignites the propellant to evolve a high pressure gas to disengage the projectile from the casing in a forward direction.

34. The projectile of claim 32, wherein the casing includes a closed end comprising a burst disk/displaceable blowout base, wherein the casing holds a propellant and a primer between the closed end and the portion of the elongate body engaged by the casing whereby triggering of the primer ignites the propellant to evolve a high pressure gas to disengage the projectile from the casing in a forward direction and wherein the high pressure gas opens the burst disk/displaceable blowout base to discharge a portion of the high pressure gas rearward through the opened burst disk/displaceable blowout base.

35. The projectile of claim 1, further comprising a waist segment longitudinally intermediate the diverging ogival nose segment and the converging ogival back segment, wherein the waist segment defines a bearing surface for contacting the bore.

36. The projectile of claim 1, wherein the elongate body is continuously curvilinear along the longitudinal axis from the elongate body leading end to the elongate body trailing end, and the continuously curvilinear elongate body encompasses a surface variation.

* * * * *